US010107306B2

(12) United States Patent
Haaf et al.

(10) Patent No.: US 10,107,306 B2
(45) Date of Patent: Oct. 23, 2018

(54) HOUSING FOR AN AXIAL FAN

(71) Applicant: ebm-papst Mulfingen GmbH & Co. KG, Mulfingen (DE)

(72) Inventors: Oliver Haaf, Kupferzell (DE); Matthias Maschke, Kupferzell (DE); Dieter Best, Ingelfingen (DE); Thomas Sauer, Bad Mergentheim (DE); Sebastian Bundschuh, Grünsfeld-Paimar (DE); Sven Beck, Krautheim (DE); Markus Engert, Lauda-Königshofen (DE); Jürgen Schöne, Bad Mergentheim (DE); Alexander Lust, Obersulm (DE); Sebastian Hoss, Bad Mergentheim (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 676 days.

(21) Appl. No.: 14/433,913

(22) PCT Filed: Apr. 12, 2013

(86) PCT No.: PCT/EP2013/057667
§ 371 (c)(1),
(2) Date: Apr. 7, 2015

(87) PCT Pub. No.: WO2014/056630
PCT Pub. Date: Apr. 17, 2014

(65) Prior Publication Data

US 2015/0267716 A1 Sep. 24, 2015

(30) Foreign Application Priority Data

Oct. 8, 2012 (EP) ..... 12187622

(51) Int. Cl.
*F04D 29/66* (2006.01)
*F04D 19/00* (2006.01)
(Continued)

(52) U.S. Cl.
CPC ..... *F04D 29/663* (2013.01); *F04D 19/002* (2013.01); *F04D 25/08* (2013.01);
(Continued)

(58) Field of Classification Search
CPC ..... F04D 19/002; F04D 25/02; F04D 25/08; F04D 29/32; F04D 29/325; F04D 29/40;
(Continued)

(56) References Cited

U.S. PATENT DOCUMENTS 4,353,680 A * 10/1982 Hiraoka ..... F04D 29/522 415/201
5,567,200 A * 10/1996 Swartzendruber ... A01K 1/0052 454/257
(Continued)

FOREIGN PATENT DOCUMENTS

DE 202010016820 U1 3/2012
GB 407268 A 3/1934
GB 664011 A 1/1952

*Primary Examiner* — Richard Edgar
*Assistant Examiner* — Alexander White
(74) *Attorney, Agent, or Firm* — Brinks Gilson & Lione

(57) ABSTRACT

A housing for a fan or blower, in particular an axial fan, includes a wall ring (2) having an inlet nozzle section (3), an outer diffuser (6) having an inlet flow opening (7) and an outlet flow opening (8), and a holder for an electric motor (9) of the fan. The holder is arranged in an inner space of the housing. The outer diffuser (6) is formed by at least two partial ring sections that are connected to the outer circumferential surface via mechanical connection elements. The holder includes several struts (14) that are fastened to an inner circumferential surface of the outer diffuser (6) by one end, are circumferentially spaced apart, and are fastened in
(Continued)

the edge region of the inlet flow opening (7). The struts can be installed by their other end to a motor flange (16) of the motor housing (17) of the electric motor (9).

24 Claims, 6 Drawing Sheets

(51) Int. Cl.

| | |
|---|---|
| ***F04D 29/32*** | (2006.01) |
| ***F04D 29/54*** | (2006.01) |
| ***F04D 29/64*** | (2006.01) |
| ***F04D 25/08*** | (2006.01) |
| ***F24F 13/20*** | (2006.01) |
| ***F24F 7/007*** | (2006.01) |

(52) U.S. Cl.
CPC ..... *F04D 29/325* (2013.01); *F04D 29/545* (2013.01); *F04D 29/646* (2013.01); *F24F 7/007* (2013.01); *F24F 13/20* (2013.01)

(58) Field of Classification Search
CPC ..... F04D 29/64; F04D 29/644; F04D 29/646; F04D 29/663; F04D 29/70; F04D 29/703; F24F 7/007; F24F 13/20
See application file for complete search history.

(56) References Cited

U.S. PATENT DOCUMENTS

| | | | | |
|---|---|---|---|---|
| 5,716,161 | A * | 2/1998 | Moore | F16B 5/065 24/453 |
| D728,090 | S * | 4/2015 | Haaf | D23/370 |
| D733,861 | S * | 7/2015 | Haaf | D23/370 |
| 2004/0253074 | A1* | 12/2004 | Anscher | F16B 19/1081 411/45 |
| 2010/0319380 | A1* | 12/2010 | Mochizuki | F24F 1/06 62/259.1 |
| 2011/0200438 | A1* | 8/2011 | Ruckert | F04D 25/0613 416/180 |
| 2012/0039731 | A1* | 2/2012 | Sadi | F04D 29/164 417/423.7 |
| 2013/0051999 | A1* | 2/2013 | Wenger | F04D 25/08 415/200 |
| 2014/0086728 | A1* | 3/2014 | Engert | F04D 29/547 415/119 |

* cited by examiner

HOUSING FOR AN AXIAL FAN

CROSS-REFERENCE TO RELATED APPLICATIONS

This application is the National Phase of International Patent Application PCT/EP2013/057667, filed on Apr. 12, 2013, and claims priority to European Patent Application 12187622.1, filed on Oct. 8, 2012, the contents of which are hereby incorporated by reference in their entirety.

TECHNICAL FIELD

The present invention relates to a housing for a fan or a blower, in particular for an axial fan, comprising a wall ring with an inlet nozzle section and an annular diffuser connected to the latter on the outflow side, with an inlet flow opening and an outlet flow opening as well as a holder for an electric motor of the fan, which holder is arranged in an inner space of the housing.

BACKGROUND

Among the known housings of this type—see U.S. Pat. No. 2,144,035—the diffuser is manufactured as a sheet metal part, but this results in relatively high manufacturing costs and, in addition, the known solution has a has relatively poor efficiency and a high noise level, precisely in particular in the medium and lower pressure range.

SUMMARY OF THE INVENTION

It is the underlying object of the present invention on the one hand to achieve a cost reduction and on the other hand to improve the efficiency and noise production in the medium and lower pressure range. In addition, the installation should be simplified.

In accordance with the present invention, this is achieved in that the outer diffuser is formed from at least two partial ring sections that are connected to its outer circumferential area via mechanical connecting elements, and the holder consists of several struts that can be fastened to an inner circumferential surface of the diffuser by one end, are circumferentially spaced apart, and that can be fastened in the edge region of the inlet flow opening, which struts can be installed by their other end to a motor flange of the motor housing of the electric motor. Advantageously, the outer diffuser is formed from four partial ring sections and four equally spaced struts are provided that in particular are each formed from two parallel spokes. In particular, the outer diffuser according to the present invention is made of plastic, and the mechanical connection of the individual partial ring sections is made with screws or rivets or with plug connections. The multi-part nature of the outer diffuser reduces tool costs. Furthermore, it is advantageous if the outer diffuser conically widens from its inlet flow opening to its outlet flow opening at a cone angle $\alpha$ relative to its mean axis X-X of 10° to 18°, in particular 12° to 15°. The course of the circumferential wall of the diffuser from the inlet flow opening to the outlet flow opening can be either straight or curved. Here, according to the present invention, it is advantageous, if the diffuser has a height, measured in the direction of the longitudinal axis X-X above the blades of the axial fan arranged in the wall ring, that is greater than or equal to 200 mm to 800 mm, with a ratio L:D1 of 0.25 to 1.0, preferentially 0.25 to 0.8, wherein L is the height of the outer diffuser measured in the direction of the longitudinal axis X-X above the blades arranged in the wall ring, and D1 is the diameter of the inlet flow opening. By this dimensioning according to the present invention, the efficiency of the housing according to the present invention and the noise development in particular in the medium and lower pressure range are achieved.

Furthermore, according to the present invention, it is provided that an inner diffuser is arranged inside the outer diffuser centrally with respect to the middle axis, which inner diffuser extends from the inlet flow opening to the outlet flow opening and has a closed circumferential wall, and which can be connected to the motor flange of the motor housing of the electric motor in the region of the inlet flow opening. Here, in the connecting region for the motor flange, the inner diffuser has a circumferential wall with a circular flow cross section and forms an annular section that tapers into an air guiding section with a polygonal, especially square cross section, especially with rounded corners. This air guiding section, in particular starting from the annular section, has an inner space that expands toward the opposite end, that is, toward the outlet flow opening.

The arrangement according to the present invention and the configuration of the inner diffuser prevent a return flow at the hub and optimize the efficiency. According to the present invention, it is further advantageous, if a circular protective grid is arranged in an opening plane of the outer diffuser running perpendicularly with respect to the longitudinal axis X-S in the region of the outlet flow opening, which grid is connected by its outer circumferential edge to the outer diffuser. Hereby, according to the present invention, the inner diffuser likewise is connected to the protective grid in that an end cover lies on the protective grid on its side facing the outflow direction, which cover is detachably connected to the air guiding section of the inner diffuser via fastening elements in such a way that the protective grid is enclosed between the end cover and the air guiding section. The protective grid according to the present invention preferentially has a quadratic mesh. Hereby a large mesh size is advantageous, for example 30 mm to a maximum of 40 mm in the case of quadratic meshes. As the protective grid is supported on the inner diffuser, the "walkability" of the housing according to the present invention is ensured. Furthermore, according to the present invention, a plug connection can be provided between the inner diffuser and the motor flange, so that the installation is substantially simplified.

Advantageous embodiments of the invention will be explained in more detail with reference to the exemplary embodiments shown in the attached drawings.

DETAILED DESCRIPTION OF THE DRAWINGS

Figure 1:
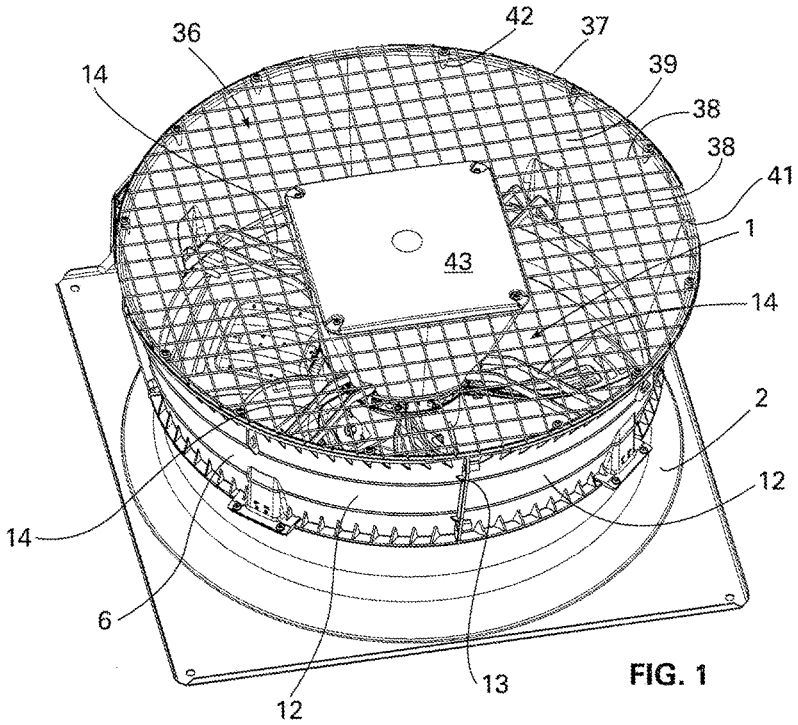
FIG. 1 shows a perspective top view of the housing according to the present invention with the electric motor located therein, with the installed blower wheel.

In FIGS. 1 to 10, same or functionally identical parts are always designated with same reference numerals. If certain features described and/or apparent from the drawings of the housing according to the present invention or components thereof are described only in connection with an exemplary embodiment, they are also aspects of the present invention independently of this exemplary embodiment as an individual feature, but also in combination with other features of the exemplary embodiment.

Figure 2:
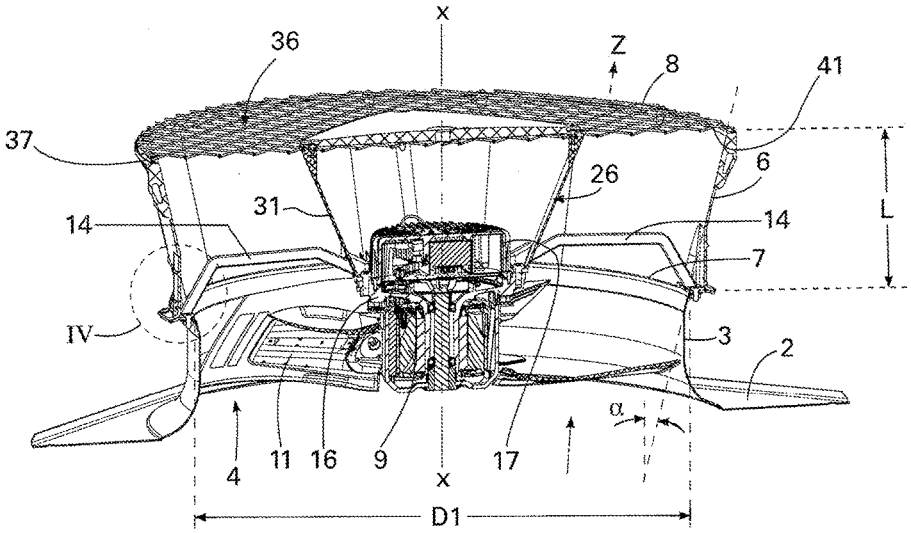
FIG. 2 shows a section along section line II-II in FIG. 1.
Figure 3:
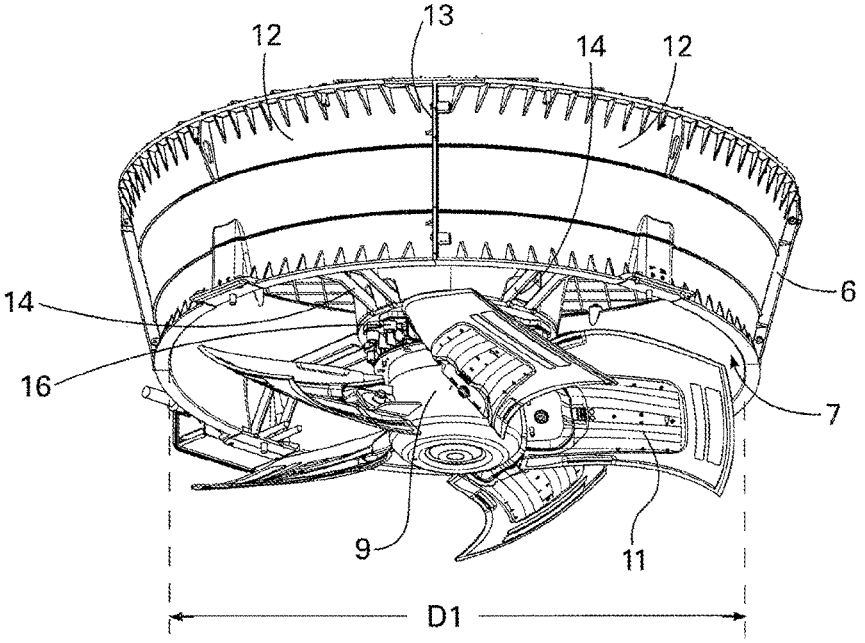
FIG. 3 shows a perspective bottom view on an outer diffuser according to the present invention with the installed electric motor and the axial blower wheel.

As is especially evident in FIGS. 1, 2, and 3, a housing according to the present invention for an axial fan 1 consists of a wall ring 2 with an inlet nozzle section 3, which in particular is made of metal. This inlet nozzle section 3 encloses a suction channel 4 that has a circular cross section. An annular outer diffusor 6 is connected to the wall ring 2 at the free end of the inlet nozzle section 3, which outer diffuser 6 has an especially circular inlet flow opening 7 and an especially circular outlet flow opening 8. The flow direction of a medium to be transported through the housing by the axial fan 1 is indicated with "Z." The axial fan 1 consists of an electric motor 9 to which a blade wheel 11 is drivingly connected. The outer diffuser 6 preferentially consists of at least two partial ring sections 12, wherein the shown exemplary embodiment, shows four partial ring sections 12, which are connected to one another on an outer circumferential surface of the outer diffuser 6 via mechanical connecting elements 13. Each partial ring section 12 extends over a specific circumferential region, so that in the finished mounted state, the partial ring sections 12 are connected to a ring part closed along the circumference. The outer diffuser 6 advantageously consists of plastic, and the connecting elements 13 can be, for example, screws, rivets, or a latch connection. Furthermore, the housing according to the present invention has a holder made of at least three struts 14, which are equally spaced apart circumferentially from one another. These struts 14 can be fastened in the edge region of the inlet flow opening 7 to the inner circumferential surface of the outer diffuser 6. With their other end, the struts 14 can be fastened to a motor flange 16 of the electric motor 9 or of a housing 17 of the electric motor 9. For fastening to the motor flange 16, the struts 14 are conveniently connected to one another at the end via a ring flange 14*a*, wherein the ring flange 14*a* is fastened via connecting elements, for example screws, to the motor flange 16. The struts 14 form a supporting star 16 with the ring flange 14*a*.

As is in particular apparent from FIG. 2, the outer diffuser 6 has a height L measured in the direction of the longitudinal axis X-X above the blades of the blade wheel 11 arranged in the wall ring 2 on the inlet nozzle section 3, which height in particular is greater than or equal to 200 mm up to including 800 mm. Here, the ratio L/D1 is preferentially 0.25 to 1.0, in particular 0.25 to 0.8, wherein D1 is the diameter of the inlet flow opening 7 of the outer diffuser 6. The outer diffuser 6 widens conically from its inlet flow opening 7 to its outlet flow opening 8 at a cone angle α with respect to its central axis X-X of in particular 10° to 18°, preferentially 12° to 15°.

Figure 4:
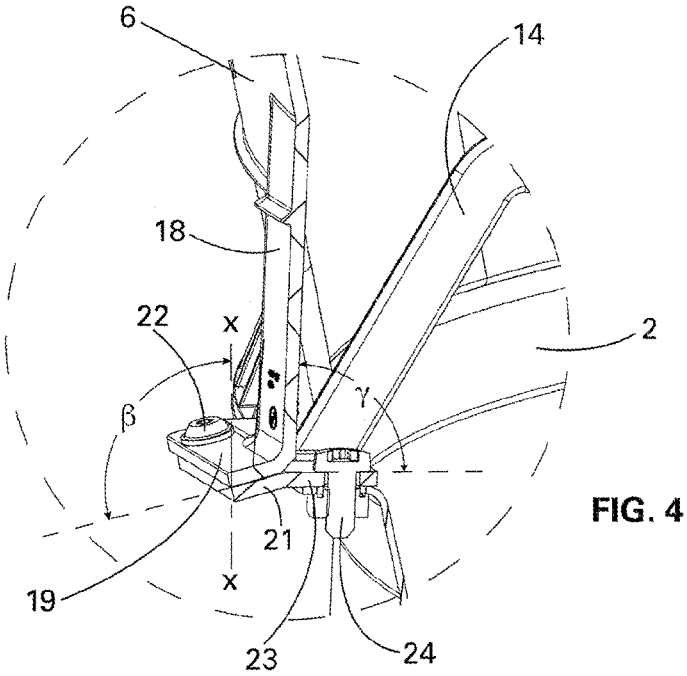
FIG. 4 shows a detail of IV in FIG. 2.
Figure 5:
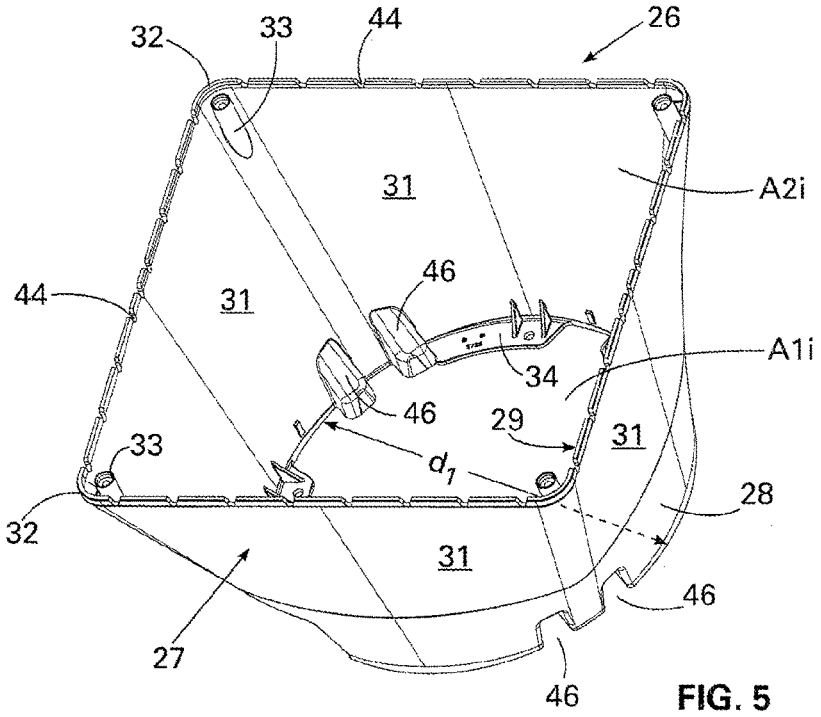
FIG. 5 shows a perspective view of an inner diffuser according to present the invention without the end cover.

Furthermore, it can be seen in FIG. 4 that on its outer side in the region of the inlet flow opening 7, the outer diffuser 6 has four fastening regions 18 corresponding to the number of struts 14, that is, in the present exemplary embodiment. These fastening regions 18 are in particular widened outward at an angle γ between 90° and 90°+α, and preferentially have an angle piece 19 on their free end. This angle piece 19 is bent at the angle β relative to the longitudinal axis X-X. This angle piece 19 is supported by a tab 21, which is configured at the end on the struts 14, and likewise is arranged at the angle β relative to the longitudinal axis X-X. The angle β must be ≥90°+α (α=the cone angle). For fastening the outer diffuser 6 to the struts 14, the angle piece 19 is screwed into the respective tab 21, for example, via a screw 22. At the same time, the wall ring 2 with a radially projecting ring collar 23 is screwed to the tab 21 via a screw. This embodiment of the fastening regions 18 allows a subsequent installation or disassembly of the complete system without the wall ring according to FIG. 3, without having to remove the individual parts.

As is furthermore apparent from FIGS. 1 to 3 and 5, an inner diffuser 26 is in particular arranged within the outer diffuser 6. In this case, the inner diffuser 26 is arranged in the center with respect to the longitudinal axis X-X. The inner diffuser 26 extends from the inlet flow opening 7 to the outlet flow opening 8 and has a closed circumferential wall 27. In the region of the inlet flow opening 7, the inner diffuser 26 can be connected to the motor flange 16 of the motor housing 17. For this purpose, in the connecting region with the motor flange 16, the inner diffuser 26 has an annular section 28, which has a circular cross section with the inner diameter $d_1$, which tapers toward an air guiding section 29 that is in particular quadrangular, especially square in cross section with preferentially rounded corners. As regards the configuration of the outer diffuser 6 and of the inner diffuser 26, reference is also made in full to WO 2012/084725 A1. Starting from the annular section 28, the air guiding section 29 has an outlet surface $A_{2i}$ changing toward the end opposite the section 28, wherein the optimal surface change $\Delta A_i$ with respect to its inlet surface $A_{1i}$ is calculated with an expansion factor k with $$k = \left[ \frac{\sqrt{(D_1 + 2 \times L \times \tan\alpha)^2 - (D_1^2 - d_1^2) \times \left( \frac{L}{D_1} - 0.45 \times \left( \frac{L}{D_1} \right)^2 + 1 \right)} - d_1}{2 \times L} \right]$$

and the formula $$\Delta A_i = A_{2i} - A_{1i} = \pi \times (d_1 + k + L) \times (k \times L)$$

and the thus calculated outlet surface $A_{2i}$ of the air guiding section 29 differs by a maximum of 20% from the calculated optimal value, wherein $A_{1i}$ is the opening surface of the inner diffuser 26 at the beginning of its annular section 28, and $A_{2i}$ is the opening surface of the inner diffuser at its end adjacent to the protective grid 36. Advantageously, the air guiding section 29 has rounded corners 32. There are tensioned connectors 33 with screw holes provided in these corners 32. As can be seen from FIG. 2, the inner diffuser 26 is dimensioned such that the motor housing 17 of the electric motor 9 can be accommodated in its inner space. For securing the inner diffuser 26 to the motor flange 16, the inner diffuser 26 preferentially has radially inward facing fastening tabs 34 at the end of the annular section 28 facing the motor flange 16. With these fastening tabs 34, the inner diffuser 26 can be fastened to the motor flange 16 via fastening elements, for example screws. For this purpose, holes 60 are provided in the fastening flange, through which the fastening elements pass. On both sides of the holes 60 there are stiffening sections 35 formed in the angular region between the fastening tabs 34 and the inner diffuser 26.

Furthermore, it is apparent from FIGS. 1 to 4 that in an opening plane of the outlet flow opening 8 running perpendicularly to the longitudinal axis X-X, a circular protective grid 36 is arranged that is connected with its outer circumferential edge 37 to the outer diffuser 6 in the edge region of its outlet flow opening 8. This can be a screw connection. The protective grid 36 is formed from individual grid wires 38, which are arranged crosswise in such a way that square, preferentially quadratic meshes 39 are configured. The mesh size, that is, the spacing of the grid wires 38 running parallel to one another is 30 mm to a maximum of 40 mm. In its edge region encompassing the outlet flow opening 8, the outer diffuser 6 has recesses 41 which are fit to the contour of the grid wires 38, so that the grid wires 38 are accommodated in these recesses 41. The protective grid 36 has fastening tabs projecting radially inward that interact with fastening lugs 42 formed on the inside of the outer diffuser 6, and are connected to the outer diffuser 6 via screws that are screwed into the fastening lugs 42.

It may further be seen that the inner diffuser 26 preferentially has a closing cover 43, which lies on the protective grid 36 on its side facing the outflow direction, and is detachably connected to the air guiding section 29 via fastening elements, for example screws, in such a way that the protective grid 36 is enclosed between the end cover 43 and the air guiding section 29. The tensioned connectors 33, in the corners 32 of the inner diffuser 26, in which the screws are screwed through the end cover 43 into the tensioned connectors 33 serve to secure the end cover 43 via screws. For accommodating the protective grid 36 with its grid wires 38 in the edge region of the air guiding section 29, the latter likewise has recesses 44, which fit the shape and size of the grid wires 38.

It can further be seen that the inner diffuser 26 has protrusions 46 in the region of its ring section 28, especially projecting into the inner space of the diffuser. In installed state, the spokes of the struts 14 run through the channels formed by the protrusions 46, so that the outer wall region of the inner diffuser 26 is not interrupted by the struts 14, but forms a closed wall surface also in this region.

In its pre-installed state, a diffuser unit according to the present invention consisting of the outer diffuser 6 and the inner diffuser 26, including the protective grid 36 and the end cover 43, can be conveniently connected to the fan unit, consisting of the fan 1, the wall ring 2, and the supporting star formed from the struts 14 and the ring flange 14*a*, via plugs and screws. The screw connections are conveniently made as described in FIG. 4, wherein the outer diffuser 6 is screwed on, for example, with eight screws 22. The plug connection is made between the inner diffuser 26 and the supporting star in the region of the ring flange 14*a*. For this purpose, it is advantageous, see FIGS. 7 to 10, if the plug connection is formed from several latch connectors 50, which are fastened to the ring flange 14*a*, with which a force fitting or positive locking connection is established between the ring flange 14*a* and the inner diffuser 26. These latch connectors 50 are preferentially formed as snap-in hooks, see FIG. 9. These snap-in hooks comprise a cylindrical fastening section 51, which preferentially has an external thread 52, by which it is screwed into a threaded hole in the ring flange 14*a*. The fastening section 51 has a central longitudinal axis X-X. In the axial direction of the longitudinal axis X-X, a latch section 53 abuts the fastening section 51. In particular, between the fastening section 51 and the latch section 53, there is a plate-shaped stop section 54, which delimits the screw path of the fastening section 51. The latch section 53 comprises a central shaft 55, which in particular ends in a truncated cone-like tip 56, wherein the tip 56 forms the smaller truncated cone surface with its end surface.

Figure 8:
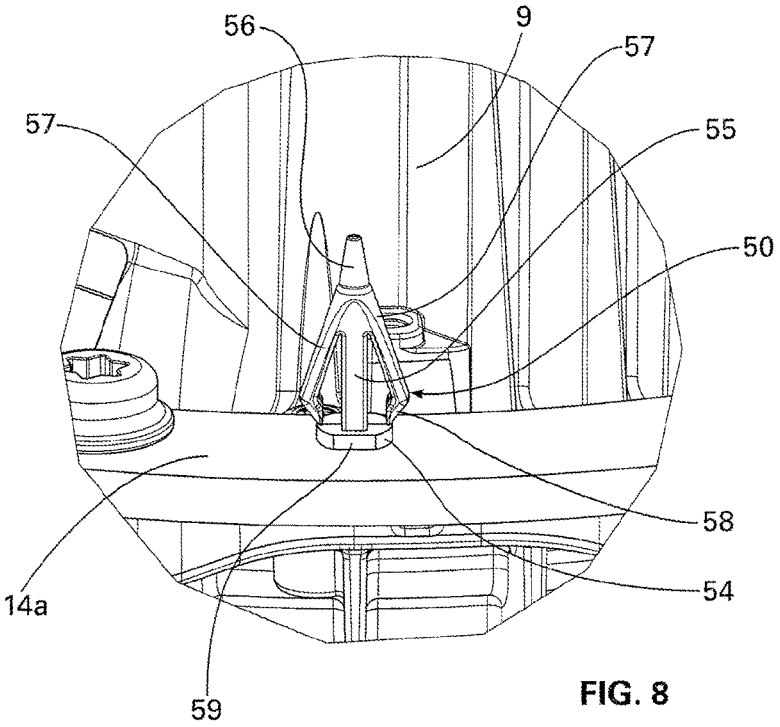
FIG. 8 shows a detail according to FIG. 7 at A.
Figure 9:
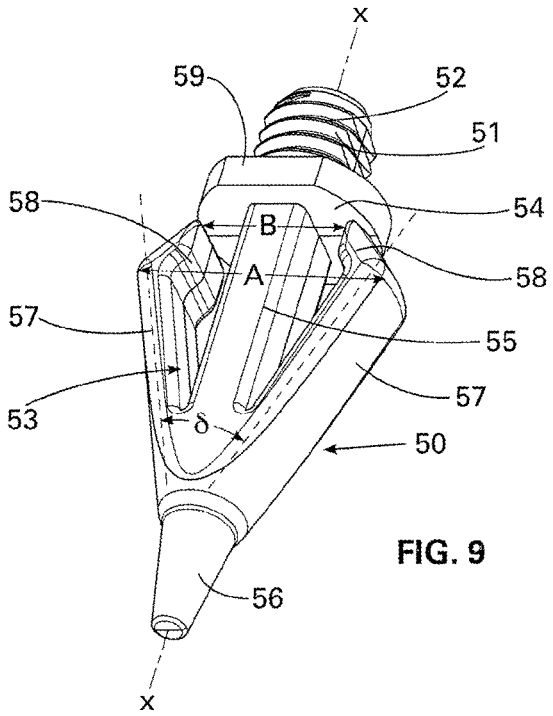
FIG. 9 shows a perspective view of a plug connector according to the present invention.
Figure 10:
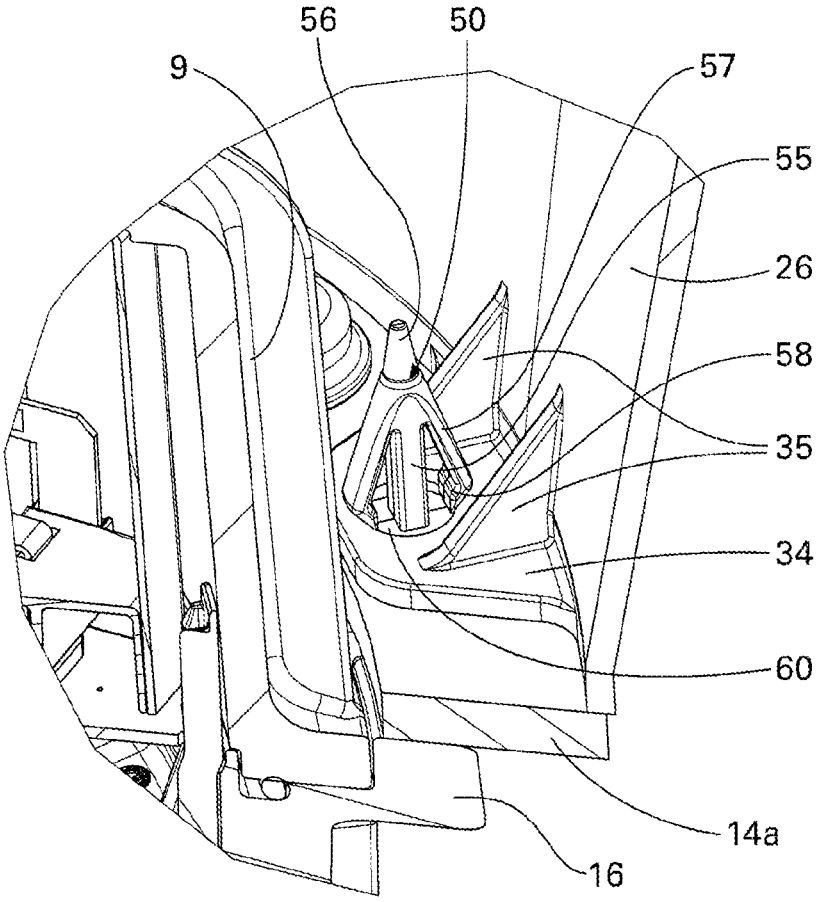
FIG. 10 shows a partial view according to FIG. 8 with the connected inner diffuser.

At the transition between the tip 56 and the shaft 55, there are, for example, two opposite spring elastic latch arms 57. These latch arms 57 extend in the axial direction of the longitudinal axis X-X toward the fastening section 51, and run obliquely to the longitudinal axis X-X in such a way that together they enclose an angle $\delta$ of 36°±3° in a perpendicular plane running through the longitudinal axis X-X. At their free ends, the latch arms 57 each have an angle section 58, which is bent with respect to the latch arms 57 in such a way that it runs in the direction of the longitudinal axis X-X. Here, a radial separation A between the ends of the latch arms 57 is greater than a radial separation B between the ends of the angle sections 58. The latch connector 50 is preferentially manufactured as a molded plastic part. Circumferentially, the stop section 54 advantageously has two opposite flat portions 59, which can serve as wrench flats. Four latch connectors 50 are preferentially screwed into the ring flange 14*a* with a 90° offset to one another. In FIG. 8, the screwed-in state of a latch connector 50 according to the present invention can be seen. FIG. 10 shows a cutout the installation position of an inner diffuser 26 of the diffuser unit according to the present invention, wherein, in particular, the latch connection between the inner diffuser 26 in the latch connector 50 can be seen. For this purpose, the inner diffuser 26 has the holes 60 in its fastening tabs 34, the diameter of the holes 60 being fitted to the radial separations A and B of the spring elastic latch arm 57 in such a way that the latch arms are radially pressed toward one another by pushing the latch connector 50 through the respective hole 60, and which after completing the plugging process, spring back again, and in this position engage the edge region of the holes 60. With the angle sections 58 at their ends, they abut the inner edge of the holes 60 with their outer surfaces under pretensioning. The angle sections 58 here have an oblique position with respect to the longitudinal axis X-X such that there is a self-retention, so that the latch arms 57 cannot be moved owing to force effects arising during operation from the installation-latch position. A detachment is only possible by manual compression of the latch arms 57. Tolerance differences between the components can be compensated by the angle sections 58, which abut the inner edge of the respective holes 60 under pre-tensioning in the installation position. In addition, the diffuser unit according to the present invention is centered during the installation via the latch arms 57 present on the shaft 55. The axial height of the plate-like stop section 54 is less than the depth of the respective holes 60 in the fastening tabs 34 of the inner diffuser 26.

Although the latch connector 50 has been described above as a component of the housing according to the present invention, the embodiment of the latch connector 50 per se is likewise based on an invention, in particular for use in a housing according to the present invention.

Figure 6:
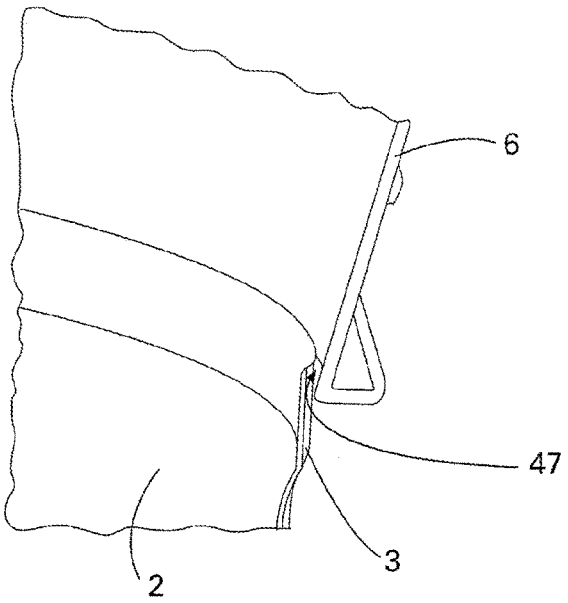
FIG. 6 shows a partial view of another embodiment of the housing according to the present invention.
Figure 7:
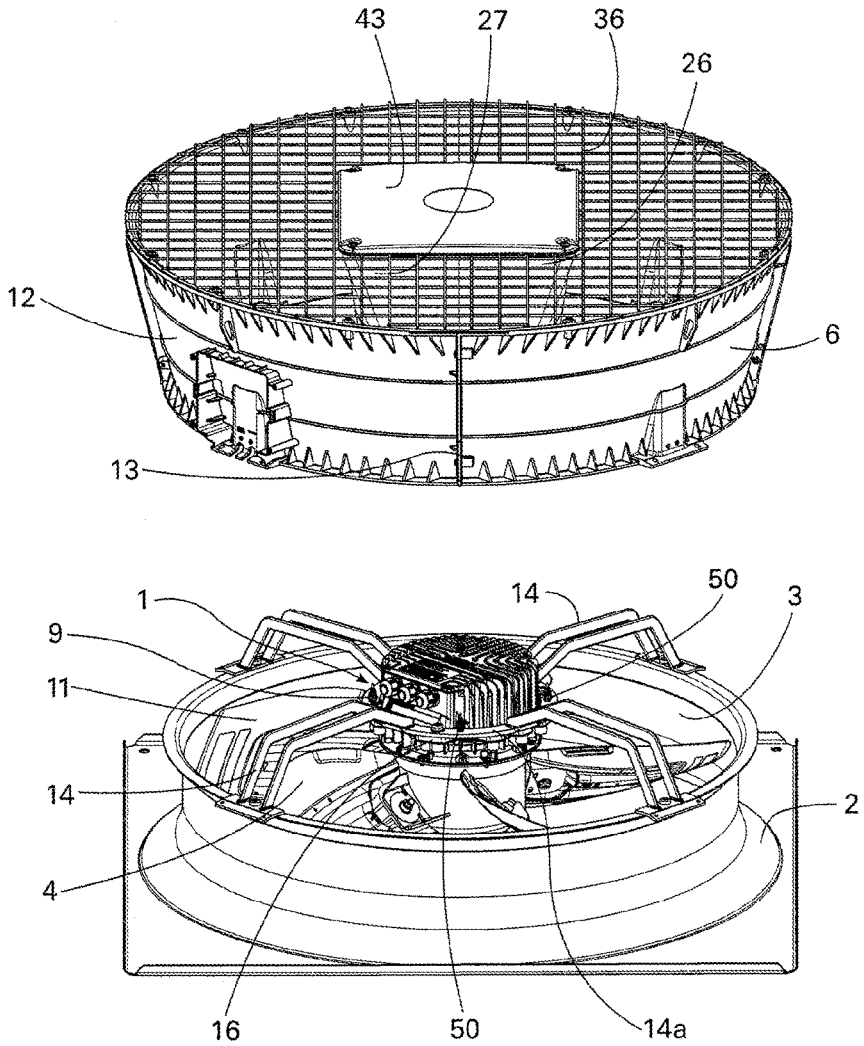
FIG. 7 shows a perspective view of a housing according to the present invention with supporting star with plug connection for an inner diffuser according to the present invention before the installation of the outer and inner diffuser.

FIG. 6 shows a partial view of another embodiment of a housing according to the present invention. Here, the wall ring 2 with its inlet nozzle section 3 projects into the outer diffuser 6 through its inlet flow opening 7, so that there is an overlap region between the inlet nozzle section 3 and the outer diffuser 6 in the region of its section adjacent to the inlet flow opening 7. In this way, an axial gap 47 is formed between these two parts, through which air can enter from the outside into the inner space of the outer diffuser 6. Through the overlap or superposition, air entering through the axial gap 47 flows parallel to the air transported in the inner space of the diffuser, so that in this way there is no oblique flow with respect to the transported air, which could cause disruptive turbulences.

As can, in particular, be seen in FIG. 3, the embodiment of the housing according to the present invention makes it possible for the outer diffuser 6, the inner diffuser 26, the protective grid 36, and the struts 14 with the axial fan 1 consisting of the electric motor 9 and the blade wheel 11, to be prefabricated as a structural unit. This structural unit can then be fastened on-site to an already pre-installed wall ring 2. The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are inside the scope of the invention as determined by the appended claims when interpreted in accordance with the breadth to which they are fairly, legally, and equitably entitled.

What is claimed is:

1. A housing for an axial fan (1), comprising a wall ring (2) with an inlet nozzle section (3) and an outflow side, the wall ring (2) configured for surrounding a blade wheel, an annular outer diffuser (6) connected to the wall ring (2) on the outflow side of the wall ring (2), a holder for an electric motor (9) of the axial fan (1), the holder being arranged in an inner space of the housing, an inner diffuser (26) arranged inside the outer diffuser (6), a motor housing (17) of the electric motor (9) disposed inside the inner diffuser (26), and a protective grid (36) being fastened to the outer diffuser (6), wherein the outer diffuser (6) having an inlet flow opening (7) and an outlet flow opening (8) and being formed from at least two partial ring sections (12), which are connected via mechanical connecting elements (13) on an outer circumferential surface of the outer diffusor (6), the outer diffusor (6) widening conically from the inlet flow opening (7) toward the outlet flow opening (8) at a cone angle ($\alpha$) with respect to a central longitudinal axis (X-X), and the holder being formed of several struts (14) to be fastened to an inner circumferential surface of the outer diffuser (6) at first strut ends, the struts (14) being circumferentially spaced apart and fastened at the first strut ends in an edge region of the inlet flow opening (7), the struts (14) being configured to be installed to a motor flange (16) of the motor housing (17) of the electric motor (9) at second strut ends opposite the first strut ends, the inner diffuser (26) axially extending from the inlet flow opening (7) to the outlet flow opening (8) of the outer diffuser (6) and having a closed circumferential wall (27), the inner diffuser (26) configured to be connected near the inlet flow opening (7) to the motor flange (16) of the motor housing (17), wherein the motor housing (17) is disposed axially between the protective grid and the wall ring (2), the protective grid (36) being fastened in an opening plane of the outlet flow opening (8) of the outer diffuser (6), the opening plane running perpendicular to the central longitudinal axis (X-X) and axially spaced from the motor housing, the protective grid (36) being connected to the outer diffuser (6) by an outer circumferential edge (37), wherein the outer diffuser (6) has recesses (41) in a circumferential wall near the outlet flow opening (8) for accommodating grid wires (38) of the protective grid (36) and wall surfaces (31) of the inner diffuser (26) have recesses (44) at a free end in the edge region to accommodate the grid wires (38), and wherein the inner diffuser (26) has an end cover (43), covering a central portion of the protective grid (36) on a side facing the outflow direction, the end cover connected to an air guiding section (29) of the inner diffuser via fastening elements in such a way that the protective grid (36) is axially enclosed between the end cover (43) and the air guiding section (29).

2. The housing according to claim 1, wherein the outer diffuser (6) is formed from four partial ring sections (12).

3. The housing according to claim 1, wherein the struts are four spaced apart struts (14), each comprising two parallel spokes.

4. The housing according to claim 1, wherein the inlet flow opening (7) and the outlet flow opening (8) of the outer diffuser (6) are circular in cross section and wherein the cone angle (a) with respect to the central longitudinal axis (X-X) is 10° to 18°.

5. The housing according to claim 1, wherein the outer diffuser (6) is made of plastic.

6. The housing according to claim 1, further comprising the blade wheel (11) with fan blades arranged in the wall ring (2), wherein the outer diffuser (6) has a height (L) measured along the central longitudinal axis (X-X) above the fan blades, the height (L) being greater than or equal to 200 mm to including 800 mm, with a ratio $L/D_1$ of 0.25 to 1.0, with $D_1$ being the diameter of the inlet flow opening (7) and L being the height of the outer diffuser (6).

7. The housing according to claim 1, wherein the circumferential wall (27) in the connecting region for the motor flange (16) has an annular section (28), which is circular in cross section, which tapers into the air guiding section (29) with an especially square cross section, wherein its corners (32) are preferentially rounded.

8. The housing according to claim 7, wherein, starting at the annular section (28), the air guiding section (29), has an outlet surface ($A_{2i}$) that changes toward the opposite end, wherein the outer diffuser (6) has a height (L), the inlet flow opening (7) has a diameter ($D_1$), and the inner diffuser has an internal diameter ($d_1$) in a region near the inlet flow opening (7), wherein the optimal change in surface ($\Delta A_i$) with respect to its inlet surface ($A_{1i}$) is calculated with an expansion factor (k) with $$k = \left[ \frac{\sqrt{(D_1 + 2 \times L \times \tan\alpha)^2 - (D_1^2 - d_1^2) \times \left(\frac{L}{D_1} - 0.45 \times \left(\frac{L}{D_1}\right)^2 + 1\right)} - d_1}{2 \times L} \right]$$

and the formula $$\Delta A_i = A_{2i} - = \pi \times (d_1 + k + L) \times (k \times L)$$

and the thus calculated outlet surface ($A_{2i}$) of the air guiding section (29) differs by a maximum of 20% from the obtained optimal value, wherein ($A_{1i}$) is the opening surface of the inner diffuser (26) at the beginning of its annular section (28), and ($A_{2i}$) is the opening surface of the inner diffuser (26) at its end adjacent to the protective grid (36).

9. The housing according to claim 1, wherein the wall ring (2), the outer diffuser (6), and the struts (14) are fastened via the fastening elements (18, 19, 21, 22, 23).

10. The housing according to claim 9, wherein the wall ring (2) and the outer diffuser (6) have radially directed circumferential abutment surfaces (19, 21), which, in the installed state, abut one another and are connected to one another and to the struts (14) by the fastening elements (22), which run along the central longitudinal axis (X-X).

11. The housing according to claim 1, wherein the wall ring (2) with the inlet nozzle section (3) projects into the outer diffuser (6) through the inlet flow opening (7) in such a way that an axial gap (47) running along the central longitudinal axis (X-X) appears in an overlap region.

12. The housing according to claim 11, wherein the struts (14) connect the outer diffuser (6) and the wall ring (2) to the motor housing (17) through fastening elements that run radially with respect to the central longitudinal axis (X-X).

13. The housing according to claim 12, wherein the outer diffuser (6) has several fastening regions (18), that are widened in an outward direction and have an angle piece (19) at a free end, wherein the angle (β) of the angle piece (19) is $\beta \geq 90° + \alpha$, with $\alpha$=the cone angle of the outer diffuser (6) and β being the angle of the angle piece (19).

14. The housing according to claim 1, wherein the inner diffuser (26) is connected via a plug connection (50, 60) to the motor flange (16).

15. The housing according to claim 14, wherein the plug connection is formed from several latch connectors (50), which are fastened to a ring flange (14*a*) on the outer diffuser (6) to which the struts (14) are connected at the first strut end.

16. The housing according to claim 15, wherein the latch connectors (50) consists of a snap-in hook each.

17. The housing according to claim 16, wherein the snap-in hook has a fastening section (51) for fastening to the ring flange (14*a*) and a latch section (53) which connects thereto in the axial direction.

18. The housing according to claim 17, wherein the fastening section (51) is formed as an external thread section with a circumferentially arranged external thread (52).

19. The housing according to claim 17, wherein a contact section (54) is present between the fastening section (51) and the latch section (53).

20. The housing according to claim 15, wherein the latch section (53) consists of a shaft (55), to which at least two radial elastic latch arms (57) are formed, which are circumferentially spaced apart and extend along a longitudinal connector axis of each latch connector (50), the latch arms (57) extending from a tip (56) of the shaft (55) toward the fastening section (51) and together enclose an angle (□) of 36°±3° and have ends with angle sections (58) bent toward the longitudinal connector axis.

21. The housing according to claim 20, wherein the tip (56) has the shape of a truncated cone, wherein the smaller truncated cone surface lies at a free end of the tip (56).

22. The housing according to claim 20, wherein the inner diffuser (26) has fastening tabs (34) with holes (60), whose diameter is fitted to radial separations (A, B) of the spring arms in such a way that the latch arms (57) are radially pressed together by pushing the latch connector (50), and after completion of the plugging process, again spring back and in this position engage behind the fastening tabs (34) in the edge region of the holes (60), and the angle sections (58), with pre-tensioning, abut on an edge region formed by the holes (60).

23. The housing according to claim 22, wherein the angle sections (58) have an oblique position with respect to the longitudinal connector axis and cause a self-retention upon contact on the edge region of the holes (60).

24. The housing according to claim 14, wherein the latch connector (50) is formed as a molded plastic part.

* * * * *